US007048146B2

(12) United States Patent
Verespej et al.

(10) Patent No.: US 7,048,146 B2
(45) Date of Patent: May 23, 2006

(54) CONTAINER ATTACHMENT SYSTEM

(75) Inventors: Rocklin Verespej, San Clemente, CA (US); Luke Hartman, Garden Grove, CA (US)

(73) Assignee: Scholle Corporation, Irvine, CA (US)

( * ) Notice: Subject to any disclaimer, the term of this patent is extended or adjusted under 35 U.S.C. 154(b) by 0 days.

(21) Appl. No.: 10/831,561

(22) Filed: Apr. 23, 2004

(65) Prior Publication Data

US 2005/0236426 A1 Oct. 27, 2005

(51) Int. Cl.
*B65D 35/56* (2006.01)

(52) U.S. Cl. ..... 222/105; 222/153.01; 29/455.1

(58) Field of Classification Search ..... 222/92, 222/105, 153.01, 153.09; 29/455.1
See application file for complete search history.

(56) References Cited

U.S. PATENT DOCUMENTS 3,349,965 A * 10/1967 Krugger ..... 222/80
4,475,670 A * 10/1984 Rutter ..... 222/83
4,516,692 A * 5/1985 Croley ..... 222/105
4,709,835 A * 12/1987 Kruger et al. ..... 222/87
6,510,965 B1 * 1/2003 Decottignies et al. ..... 222/95
6,561,386 B1 * 5/2003 Martens ..... 222/105

* cited by examiner

*Primary Examiner*—Joseph A. Kaufman
(74) *Attorney, Agent, or Firm*—Watson IP Group, PLC; Jovan N. Jovanovic

(57) ABSTRACT

A container system comprising an outer container, an inner container and a spout. The outer container includes a body and an outer spout. The inner container includes a bag and an inner spout. The inner container is positionable within the outer container such that the inner spout can extend through the outer spout. The spout interfacing assembly comprises a gasket and a lock ring. The gasket includes an outer container interfacing surface engagable with the outer spout and an inner container interfacing surface engagable with the inner spout. The lock ring is couplable to one of the inner spout and outer spout, the lock ring capable of limiting the movement of the inner spout relative to the outer spout. The attachment of a valve assembly substantially uniformly compresses the gasket to, in turn, maintain a substantially uniform and fluid tight seal between the inner spout and the outer spout.

16 Claims, 4 Drawing Sheets

CONTAINER ATTACHMENT SYSTEM

BACKGROUND OF THE INVENTION

1. Field of the Invention

The present invention relates in general to container attachment systems, and, in particular, to a container attachment system which includes a gasket assembly for effectively associating each of the inner and outer containers together to control leakage and to, in turn, control the coupling of the two containers about the spouts thereof.

2. Background Art

Accordingly, it is an object of the invention to provide a gasket which is capable of controlling tightening of the assembly, to, in turn, preclude inadvertent over or under-tightening situations.

It is another object of the invention to provide a gasket which is capable of controlling tightening of the assembly while cooperating with standard pipes having standard ferrules.

It is a further object of the invention to provide a gasket which minimizes intrusion into the bore of the pipes.

These and other objects will become apparent in light of the specification and claims appended hereto.

SUMMARY OF THE INVENTION

The invention comprises a container system comprising an outer container, an inner container and a spout. The outer container includes a body and an outer spout. The inner container includes a bag and an inner spout. The inner container is positionable within the outer container such that the inner spout can extend through the outer spout. The spout interfacing assembly comprises a gasket and a lock ring. The gasket includes an outer container interfacing surface engagable with the outer spout and an inner container interfacing surface engagable with the inner spout. The lock ring is couplable to one of the inner spout and outer spout, and is capable of limiting the movement of the inner spout relative to the outer spout. The attachment of a valve assembly substantially uniformly compresses the gasket to, in turn, maintain a substantially uniform and fluid tight seal between the inner spout and the outer spout.

In one preferred embodiment, the outer spout comprises an outer surface, an inner surface, a proximal end and a distal end. The outer container interfacing surface of the gasket includes an outer diameter face and a flange face. The outer diameter face is positionable in sealing engagement with the inner surface of the outer spout and the flange face positionable in sealing engagement with the distal end of the outer spout.

In one such embodiment, the inner spout comprises an outer surface, an inner surface, a proximal end and a distal end. The inner container interfacing surface comprises at least one inner diameter face positionable in sealing engagement with the outer surface of the inner spout.

Preferably, the inner spout includes at least one rib extending circumferentially about the outer surface of the inner spout. The inner container interfacing surface includes at least one flange face capable of positioning in abutment with the at least one rib.

In another such preferred embodiment, the at least one rib comprises a pair of ribs spaced apart from each other a predetermined distance. In such an embodiment, the lock ring is positionable between the spaced apart pair of ribs.

In one such embodiment, the inner container interfacing surface includes a second inner diameter face positionable in abutment with the at least one rib.

Preferably, the lock ring includes a first face and a second face opposing the first face. Correspondingly, the gasket further includes a lock ring interfacing face positionable in abutment with the lock ring interfacing face.

In another preferred embodiment, the distal end of the inner container is configured to receive an interfacing face of a valve assembly. Furthermore, the outer surface of the outer spout includes an attachment member capable of releasable attachment with a valve assembly.

In another embodiment, the attachment member comprises threads which are engagable with a corresponding thread of a valve assembly.

In yet another preferred embodiment, the lock ring comprises a body having a first surface and a second surface. The lock ring is defined by an inner diameter and an outer diameter. The lock ring includes a first component and a second component movable relative to each other.

Preferably, the first component and the second component of the lock ring are hinged at a first end and selectively attachable at a second end.

In another embodiment, the first component and the second component are integrated at a first end, and capable of relative movement at a second end.

The invention further comprises a method of assembling a container system. The method comprises the steps of: (a) providing an outer container having a body and an outer spout; (b) providing an inner container having a body and a spout; (c) positioning the inner container within the outer container; (d) extending the inner spout through the outer spout; (e) providing a gasket having an outer container interfacing surface and an inner container interfacing surface; (f) positioning the gasket such that the outer container interfacing surface abuts the outer spout and the such that the inner container interfacing surface abuts the inner spout; and (g) positioning a lock ring so as to interface with at least one of the outer spout and the inner spout and the gasket, to, in turn, facilitate the engagement of the outer spout, the inner spout and the gasket in a substantially uniform and sealable position.

In a preferred embodiment, the method further includes the step of: positioning a valve assembly to facilitate selective withdrawal of fluid from within the inner container.

In another embodiment, wherein the inner spout includes at least one rib, the step of positioning the lock ring further comprises the step of positioning the lock ring so as to interface with the at least one rib on one side thereof, and so as to interface with the gasket on the other side thereof.

In another embodiment, wherein the lock ring comprises a first component and a second component, the step of positioning the lock ring further comprises the steps of: (a) positioning the first component of the lock ring; (b) positioning the second component of the lock ring; and (c) attaching the first and second components of the lock ring to each other.

BRIEF DESCRIPTION OF THE DRAWINGS

The invention will now be described with reference to the drawings wherein.

DETAILED DESCRIPTION OF THE INVENTION

Figure 1:
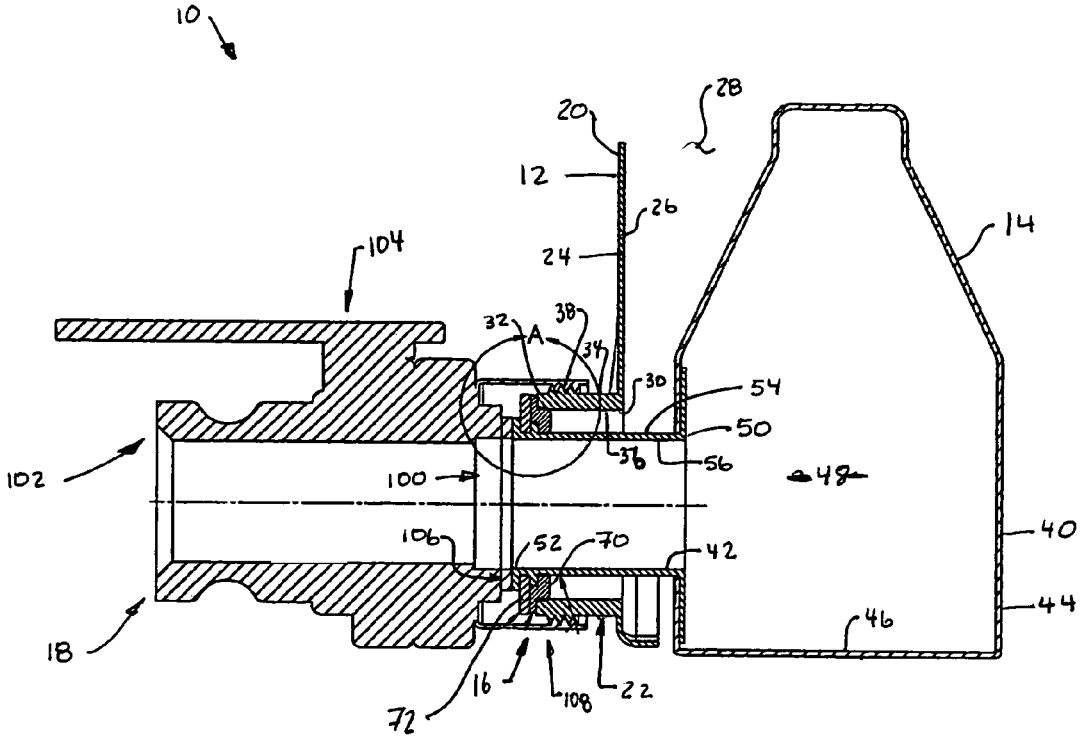
FIG. 1 of the drawings comprises a partial cross-sectional view of the container system of the present invention.

While this invention is susceptible of embodiment in many different forms, there is shown, in the drawings several specific embodiments with the understanding that the present disclosure is to be considered as an exemplification of the principles of the invention and is not intended to limit the invention to the embodiments illustrated.

It will be understood that like or analogous elements and/or components, referred to herein, are identified throughout the drawings by like reference characters. In addition, it will be understood that the drawings are merely representations of the present invention, and some of the components may have been distorted from actual scale for purposes of pictorial clarity.

Referring now to the Figures, and in particular to FIG. 1, container system 10 is shown as comprising outer container 12, inner container 14, spout interfacing assembly 16 and valve assembly 18. As is shown in FIG. 11, the container system is generally sized for the transport and dispensing of flowable material.

Figure 11:
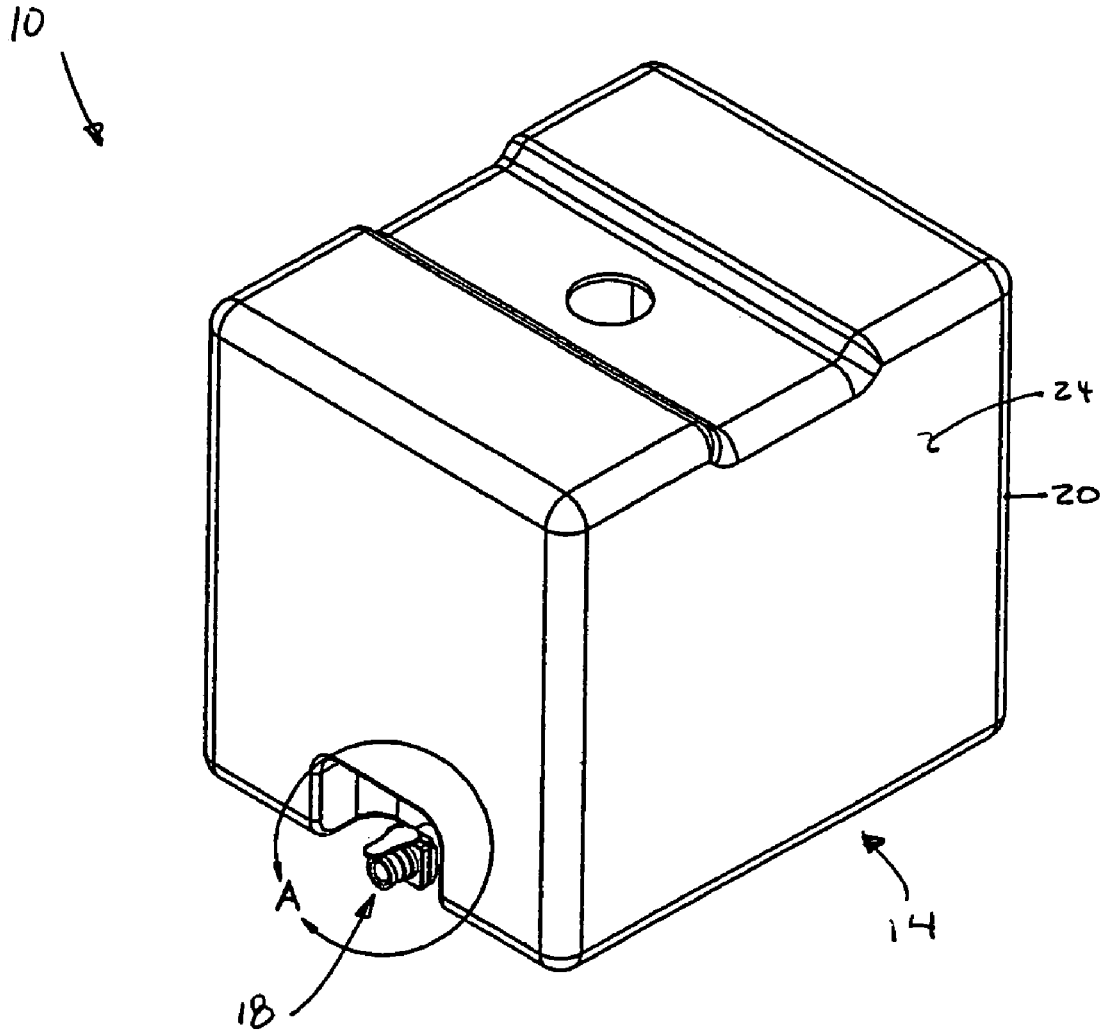
FIG. 11 of the drawings comprises a perspective view of the outer container of the present invention.

Outer container 12 is shown in FIG. 1 and in FIG. 11 as comprising body 20 and outer spout 22. Body 20 includes outer surface 24 and inner surface 26. The inner surface defines cavity 28, to which spout 22 provides ingress. Generally, the outer and inner surfaces are substantially uniformly separated, such that body 20 comprises a substantially uniform thickness. Of course, in certain embodiments, the thickness may be varied. The outer container is of a substantially rigid material, such as, for example, a rigid blow-molded polymer material. Of course, it is not limited to such materials, and, other materials are likewise contemplated. Various sizes for outer container 20 are contemplated, including but not limited to any sizes between about 2 gallons and 300 gallons. Of course, the invention is not limited to such sizes.

Spout 22 is shown in FIG. 1 as comprising proximal end 30, distal end 32, outer surface 34, inner surface 36 and attachment member 38. Proximal end 30 is coupled to body 20 of outer container 12. In the embodiment shown, the proximal end is integrated with the outer container. In other embodiments, the proximal end may be releasably coupled to the body. The distal end is spaced apart from the proximal end a predetermined distance, thus, defining a length of spout 22. The attachment member is positioned on outer surface 34 and generally comprises a plurality of threads having a predetermined pitch and threadform.

Inner container 14 is shown in FIG. 1 as comprising bag 40 and inner spout 42. Bag 40 includes outer surface 44 and inner surface 46. The outer and inner surfaces can be formed from a plurality of panels which are heat sealed together so as to define cavity 48. One such container includes two panels which are heat sealed together to form what is commonly referred to as a "pillow-type" container in a gusseted container. Such containers are generally of a flexible nature, formed from a polymer laminate material. Of course numerous types of inner containers from various materials are within the scope of the invention.

Figure 2:
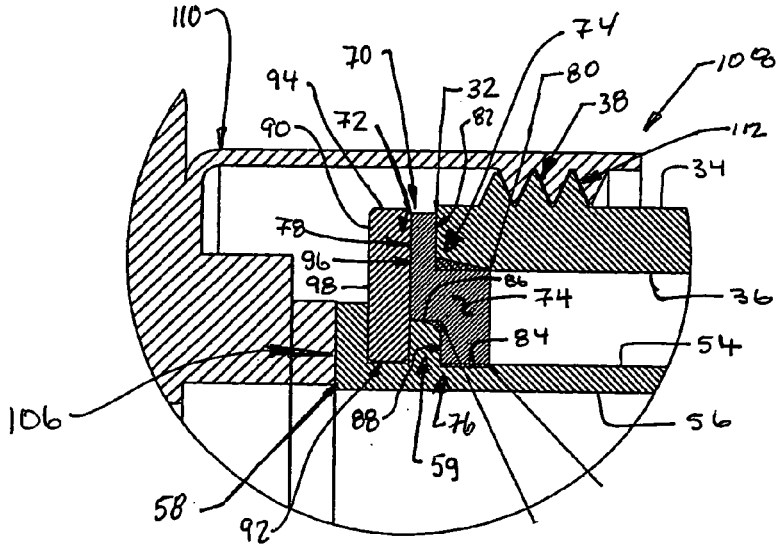
FIG. 2 of the drawings comprises a partial cross-sectional view of the portion of the container system positioned within the circular enclosure "A".
Figure 3:
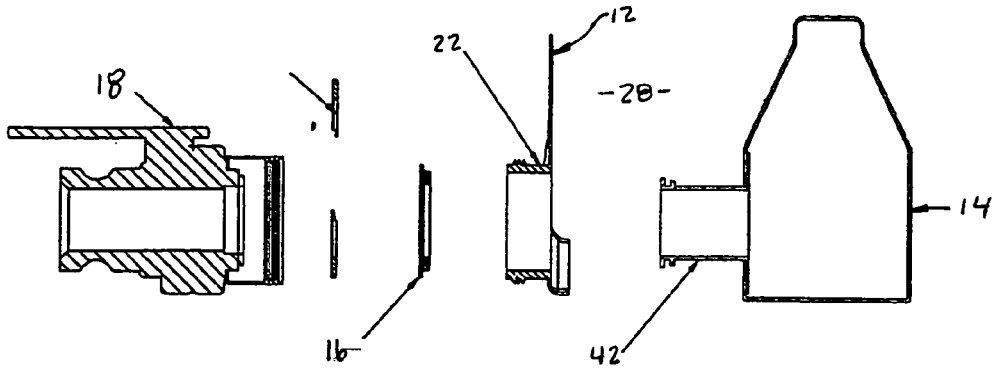
FIG. 3 of the drawings comprises an exploded partial cross-sectional view of the container system of the present invention prior to assembly thereof.

Inner spout 42 is shown in FIG. 1 as comprising proximal end 50, distal end 52, outer surface 54, inner surface 56, first rib 58 (FIG. 2) and second rib 59 (FIG. 2). Inner spout 42 is joined to inner container 14 at proximal end 50 by way of a heat seal. Of course, other variations are likewise contemplated. Distal end 52 is spaced apart from proximal end 50 a distance which substantially corresponds to the length of the inner spout. It is contemplated that in certain embodiments, the proximal end of the inner spout may extend into cavity 48. The inner spout generally comprises a molded polymer material which is of sufficient strength and rigidity for such an application.

Referring now to FIG. 2, first rib 58 extends circumferentially about outer surface 54, proximate distal end 52. In the embodiment shown, the rib is substantially orthogonal to the outer surface, and coincides with the proximal end. Second rib 59 extends circumferentially about outer surface 54 spaced apart from distal end 52 a predetermined distance toward proximal end 50. In the embodiment shown, the second rib is substantially parallel to the first rib and substantially uniform in dimension. In the embodiment shown, the two ribs are integrally molded with the inner spout and extend orthogonally about the circumference of the inner spout. Of course, in other embodiments, the positioning and configuration of each of the ribs can be varied without departing from the scope of the present invention.

Figure 8:
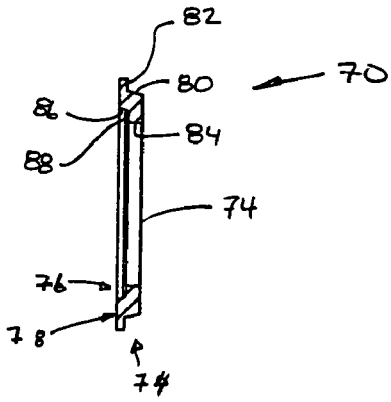
FIG. 8 of the drawings comprises a cross-sectional view of the gasket of the present invention.

Spout interfacing assembly 16 is shown in FIG. 1 as comprising gasket 70 and lock ring 72. Referring now to FIGS. 2 and 8, gasket 70 includes annular body 74. Annular body 74 includes outer container interfacing surface 74, inner container interfacing surface 76, and lock ring interfacing face 78. Outer container interfacing surface 74 includes outer diameter face 80 and flange face 82. Inner container interfacing surface 76 includes first inner diameter face 84, second inner diameter face 86 and first flange face 88. Gasket 70 preferably comprises a flexible polymer material, such as, for example, a silicone rubber, a synthetic or natural rubber material and a polymer material, among others. Of course, other configurations for each of the outer and inner interfacing surfaces are contemplated.

Figure 9:
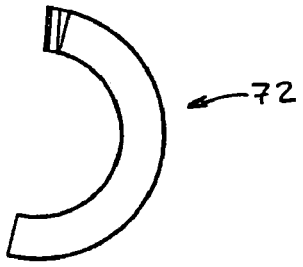
FIG. 9 of the drawings comprises a top plain view of an embodiment of the lock ring of the present invention.
Figure 10:
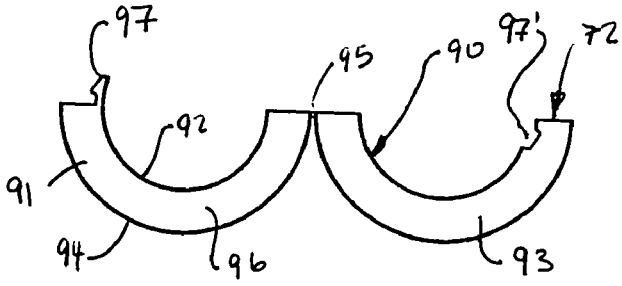
FIG. 10 of the drawings comprises a top plain view of an embodiment of the lock ring of the present invention.

Lock ring 72 is shown in FIGS. 2 and 10 as comprising body 90, inner diameter 92, outer diameter 94, first surface 96 and second surface 98. In the embodiment shown, body 90 includes a first component 91 and a second component 93 which are hinged together by way of hinge 95 at a first end and attachable by way of lock components 97, 97' at an opposite end. In turn, the two components can be hinged at the first end into and out of a lockable arrangement at the opposite end. In other embodiments, the hinge may be omitted, and the lock ring can be manipulated relying on the flexibility of the material from which it is formed. In still other embodiments, the lock ring can comprise one or more separate components such as component 99 (FIG. 9). Preferably, the lock ring is formed from a rigid polymer material such that the general washer-like shape can be maintained. Advantageously, the lock ring provides a substantially uniform load about substantially the entire 360° of the sealing surface. As such, the seal is substantially uniform and any potential for leaking can be minimized.

Valve assembly 18 is shown in FIG. 1 as comprising inlet 100, outlet 102, selective communication device 104, interfacing face 106, and attachment member 108. As is shown in detail in FIG. 2, attachment member 108 includes locking nut 110 having threads 112 disposed thereon. The threads of the locking nut are configured to interface with the threads of attachment member 38 of outer spout 22.

Figure 4:
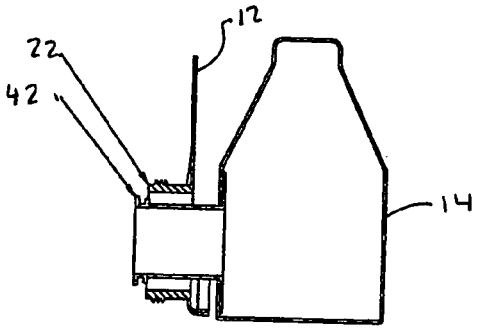
FIG. 4 of the drawings comprises a partial cross-sectional view of the container system of the present invention, showing, in particular, the step of associating the inner spout and the outer spout.

With reference to FIGS. 3 through 7, to assemble the container system of the present invention, each of inner container 14, outer container 12, spout interfacing assembly 16 and valve assembly 18 are provided. Once provided, the inner container is positioned within cavity 28 of the outer container. As is shown in FIG. 4, inner spout 42 of inner container 14 is directed through outer spout 22 of outer container 12. The distal end of the inner spout is positioned such that it extends beyond distal end of the outer spout. In certain embodiments, the body of the outer container and the bag of the inner container may interface proximate the spout, depending on the relative lengths of the outer and inner spout.

Figure 5:
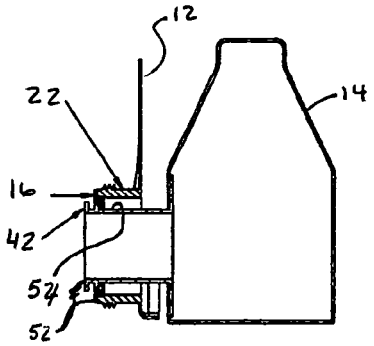
FIG. 5 of the drawings comprises a partial cross-sectional view of the container system of the present invention, showing, in particular, the step of positioning the gasket.

Next, with reference to FIG. 5, spout interfacing assembly 16 is introduced. Specifically, gasket 70 of the spout interfacing assembly is positioned about outer surface 54 of inner spout 42. Additionally, gasket 70 is positioned so as to interface with distal end 52 of outer spout 22. In more detail, and with reference to FIG. 2, outer diameter face 80 of outer container interfacing surface 74, is in an abutting relationship with inner surface 36 of outer spout 22. Additionally, flange face 82 of outer container interfacing surface 74 is in an abutting relationship with distal end 32 of outer spout 22.

As is further shown in FIG. 2, first inner diameter face 84 of inner container interfacing surface 76 is in an abutting relationship with outer surface 54 of inner spout 42. Second inner diameter face 86 of inner container interfacing surface 76 is in an abutting relationship with second rib 59. It will be understood that certain of the faces may be tapered or otherwise filleted so as to enhance the seal created by the abutting relationship. As is shown in the embodiment depicted in FIG. 2, outer diameter face 80, inner diameter face 86 of inner container interfacing surface includes such tapered structures.

Figure 6:
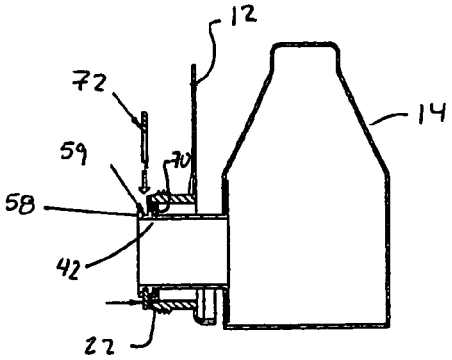
FIG. 6 of drawings comprises a partial cross-sectional view of the container system of the present invention, showing, in particular, the step of introducing the lock ring.
Figure 7:
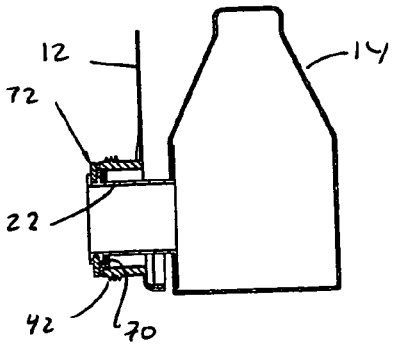
FIG. 7 of the drawings comprises a partial cross-sectional view of the present invention, showing, in particular, the fully positioned lock ring.

Once gasket 70 is positioned and located relative to the abutting structures of the inner and outer spouts 42 and 22, respectively, lock ring 72 is introduced. As is shown in FIG. 6, lock ring 72 is positioned between first rib 58 and second rib 59. With reference to FIG. 2, in such a position, lock ring interfacing face 78 is in an abutting relationship with first flange face 88 of inner container interfacing surface 76. The fully introduced lock ring 72 is shown in FIG. 7.

With reference to FIGS. 1 and 2, once the spout interfacing assembly is positioned and located, valve assembly 18 is introduced. In particular, the valve assembly is positioned such that interfacing face 106 is in abutment with inner spout 42 proximate the distal end thereof. Once positioned, the attachment member is employed. In particular, threads 112 of lock nut 110 are urged into contact with the threads of attachment member 38 of outer spout 22. As the lock nut is rotated to tighten the connection, interfacing surface 106 of valve assembly 18 presses against inner spout 42. At the same time, the outer spout is one of precluded from movement or forced in a direction opposite that of the inner spout. As the valve assembly forces the inner spout and outer spout in opposing directions, gasket 70 is compressed between outer spout 22 on one side and lock ring 72 and inner spout 42 (i.e., the second rib thereof in combination with the outer surface thereof), to effectively seal the space between the first and second spout. Due to the configuration of the lock ring and gasket, the compression of the gasket through the lock ring is substantially uniform about the entire 360° of the gasket. In turn, the uniform configuration minimizes the possibility of leaking.

Once fully assembled, the valve assembly can be selectively actuated so as to facilitate the selective dispensing of fluid therefrom. In turn, should a leak occur in bag 40 of inner container 14, the leak will be contained within body 20 of outer container 12 and will not be directed between outer spout 22 and inner spout 42.

The foregoing description merely explains and illustrates the invention and the invention is not limited thereto except insofar as the appended claims are so limited, as those skilled in the art who have the disclosure before them will be able to make modifications without departing the scope of the invention.

What is claimed is:

1. A container system comprising:

an outer container having a body and an outer spout;

an inner container having a bag and an inner spout, the inner container positionable within the outer container such that the inner spout can extend through the outer spout; and a spout interfacing assembly, comprising a gasket and a lock ring, the gasket including an outer container interfacing surface engagable with the outer spout and an inner container interfacing surface engagable with the inner spout, the lock ring couplable to one of the inner spout and outer spout, the lock ring capable of limiting the movement of the inner spout relative to the outer spout, whereupon attachment of a valve assembly substantially uniformly compresses the gasket to, in turn, maintain a substantially uniform and fluid tight seal between the inner spout and the outer spout.

2. The container system of claim 1 wherein the outer spout comprises an outer surface, an inner surface, a proximal end and a distal end, the outer container interfacing surface including an outer diameter face and a flange face, the outer diameter face positionable in sealing engagement with the inner surface of the outer spout and the flange face positionable in sealing engagement with the distal end of the outer spout.

3. The container system of claim 2 wherein the inner spout comprises an outer surface, an inner surface, a proximal end and a distal end, the inner container interfacing surface comprising at least one inner diameter face positionable in sealing engagement with the outer surface of the inner spout.

4. The container system of claim 3 wherein the inner spout includes at least one rib extending circumferentially about the outer surface of the inner spout, the inner container interfacing surface includes at least one flange face capable of positioning in abutment with the at least one rib.

5. The container system of claim 4 wherein the at least one rib comprises a pair of ribs spaced apart from each other a predetermined distance, the lock ring positionable between the spaced apart pair of ribs.

6. The container system of claim 5 wherein the inner container interfacing surface includes a second inner diameter face positionable in abutment with the at least one rib.

7. The container system of claim 6 wherein the lock ring includes a first face and a second face opposing the first face, the gasket further includes a lock ring interfacing face positionable in abutment with the lock ring interfacing face.

8. The container system of claim 3 wherein the distal end of the inner container is configured to receive an interfacing face of a valve assembly and wherein the outer surface of the outer spout includes an attachment member capable of releasable attachment with a valve assembly.

9. The container system of claim 8 wherein the attachment member comprises threads which are engagable with a corresponding thread of a valve assembly.

10. The container system of claim 1 wherein the lock ring comprises a body having a first surface and a second surface, the lock ring defined by an inner diameter and an outer diameter, the lock ring including a first component and a second component movable relative to each other.

11. The container system of claim 10 wherein the first component and the second component of the lock ring are hinged at a first end and selectively attachable at a second end.

12. The container system of claim 11 wherein the first component and the second component are integrated at a first end, and capable of relative movement at a second end.

13. A method of assembling a container system comprising:

providing an outer container having a body and an outer spout;

providing an inner container having a body and a spout;

positioning the inner container within the outer container;

extending the inner spout through the outer spout;

providing a gasket having an outer container interfacing surface and an inner container interfacing surface;

positioning the gasket such that the outer container interfacing surface abuts the outer spout and such that the inner container interfacing surface abuts the inner spout; and positioning a lock ring so as to interface with at least one of the outer spout and the inner spout and the gasket, to, in turn, facilitate the engagement of the outer spout, the inner spout and the gasket in a substantially uniform and sealable position.

14. The method of claim 13 further comprising the step of:

positioning a valve assembly to facilitate selective withdrawal of fluid from within the inner container.

15. The method of claim 13 wherein the inner spout includes at least one rib, the step of positioning the lock ring further comprises the step of positioning the lock ring so as to interface with the at least one rib on one side thereof, and so as to interface with the gasket on the other side thereof.

16. The method of claim 14 wherein the lock ring comprises a first component and a second component, the step of positioning the lock ring further comprises the steps of:

positioning the first component of the lock ring;

positioning the second component of the lock ring; and attaching the first and second components of the lock ring to each other.

* * * * *